US006146035A

United States Patent [19]

Ishigouoka et al.

[11] Patent Number: 6,146,035

[45] Date of Patent: Nov. 14, 2000

[54] PRINTING DEVICE

[75] Inventors: Hirokazu Ishigouoka; Masato Sakui; Tomoyuki Takeshita, all of Tokyo, Japan

[73] Assignee: Mitsubishi Denki Kabushiki Kaisha, Tokyo, Japan

[21] Appl. No.: 09/090,212

[22] Filed: Jun. 4, 1998

[30] Foreign Application Priority Data

Jun. 13, 1997 [JP] Japan ..... P09-156924

[51] Int. Cl.[7] ..... B41J 13/24

[52] U.S. Cl. ..... 400/621; 400/708

[58] Field of Search ..... 400/621, 707.1, 400/583.3, 82, 708; 101/226; 347/195, 197, 198; 270/1.03; 226/31; 156/277

[56] References Cited

U.S. PATENT DOCUMENTS

| | | | |
|---|---|---|---|
| 3,648,911 | 3/1972 | Pekrul . | |
| 3,875,861 | 4/1975 | Stackig . | |
| 4,541,337 | 9/1985 | Schaul | 400/583.3 |
| 4,957,381 | 9/1990 | Sakai et al. | 400/621 |
| 5,119,725 | 6/1992 | Okamura | 101/226 |
| 5,414,450 | 5/1995 | Oshino et al. | 347/197 |
| 5,425,587 | 6/1995 | Takiguchi | 400/232 |
| 5,464,289 | 11/1995 | Beaudry . | |
| 5,488,458 | 1/1996 | Benedict et al. . | |
| 5,612,727 | 3/1997 | Morimoto et al. | 347/198 |
| 5,647,938 | 7/1997 | Levine | 156/277 |
| 5,820,007 | 10/1998 | Crowley | 226/31 |
| 5,823,692 | 10/1998 | Tolrud et al. | 400/582 |

FOREIGN PATENT DOCUMENTS

| | | |
|---|---|---|
| 2 0368324 | 5/1990 | European Pat. Off. . |
| 2 0388763 | 9/1990 | European Pat. Off. . |
| 0388763 B1 | 2/1995 | European Pat. Off. . |
| 60-56777 | 4/1985 | Japan . |
| 63-209859 | 8/1988 | Japan . |

OTHER PUBLICATIONS

Patent Abstracts of Japan Publication No.: JP 57 110479 (A); Published: Jul. 9, 1982—Abstract only.

Patent Abstracts of Japan Publication No.: JP 01 163085 (A); Published: Jun. 27, 1989—Abstract only.

Patent Abstracts of Japan Publication No.: JP 63 019283 (A); Published: Jan. 27, 1988—Abstract only.

Patent Abstract of Japan, JP 55 011818A, vol. 004, No. 041, Mar. 29, 1980—Abstract only.

Patent Abstract of Japan, JP 04 329189A, vol. 017, No. 168, Mar. 31, 1993—Abstract only.

*Primary Examiner*—Eugene Eickholt

[57] ABSTRACT

A printing device that produces printed pieces of paper having no blank is provided, which can precisely position the print to contents on the back side of the printing paper. A mark (36) is provided in a blank area (38) on the back side of printing paper (3*a*). A sensor (7) senses the mark (36), whereby the position of a regular-form print area (37) adjacent to the blank area (38) on the printing paper (3*a*) can be recognized. A thermal head (1*a*) and a cutter (6) print the printing paper (3*a*) and cuts the blank area (38) away on the basis of the sense output. Accordingly, it is possible to produce a printed piece of paper having a desired print on the front side and a regular-form print on the back side printed without positional misalignment and without blank in the feed direction, with the mark (36) removed therefrom.

8 Claims, 14 Drawing Sheets

PRINTING DEVICE

BACKGROUND OF THE INVENTION

1. Field of the Invention

The present invention relates to a printing device having a printing mechanism, such as a thermal head, etc.

2. Description of the Background Art

FIG. 20 is a conceptual diagram showing a mechanism 100 of a conventional printing device (a heat transfer printer device). In FIG. 20, 1 denotes a thermal head, 2 denotes an ink sheet coated with thermo-dissolving ink or thermo-sublimating ink for heat transfer recording, 3 denotes printing paper, 4 denotes a platen roller for transferring the sheet of printing paper 3 while pressing the sheets in close contact with each other against the thermal head 1, 5 denotes pinch rollers for transferring the printing paper 3 while gripping the paper, 6 denotes a cutter for cutting the roll-type printing paper 3, and 7 denotes a reflection-type optical sensor for sensing the front end position of the printing paper 3.

FIG. 21 is a conceptual diagram showing the conventional thermal head 1. The effective heating width W1 of the thermal head 1 is shorter than the paper width W2 of the printing paper 3. FIG. 22 is a diagram showing the front side of a printed piece of paper 300 produced in the conventional system.

The conventional printing device operates as described below. Initially, suppose that the cutter 6 has cut the printing paper 3. The pinch rollers 5 transfer the printing paper 3 in the paper-supply direction. In the feed direction in which the printing paper is sent, the direction from the printing paper supplying side to the printed paper discharge side is referred to as a paper-discharge direction and the opposite direction is referred to as the paper-supply direction. The sensor 7 senses the front end 31 of the printing paper 3. The pinch rollers 5 position the front end 31 at the position of the pinch rollers 5 based on the information about the position of the front end 31 sensed by the sensor 7. Next, a desired image 30 is printed. Then, the pinch rollers 5 transfer the printing paper 3 in the paper-discharge direction and position the rear end 32 at the position of the cutter 6 such that a blank 34 is left. Then the cutter 6 cuts the printing paper 3. In the conventional system, the positioning of the printing paper 3 is thus obtained on the basis of the positional information about the front end 31 of the printing paper 3.

The conventional heat transfer printer device has the following problems. Since the effective heating width W1 of the thermal head 1 is shorter than the width W2 of the printing paper 3 as shown in FIG. 21, the printed piece of paper 300 has blanks 35 in its width direction, as shown in FIG. 22. Further, since the conventional heat transfer printer device operates as described above, blanks are left in the feed direction on the printed piece of paper 300, as shown in FIG. 22. More specifically, the printed paper has a gripping blank 33 having the width L from a pinch rollers 5 to the thermal head 1 and a margin blank 34 for preventing the image 30 from being cut.

Further, the positioning of the printing paper 3 is obtained on the basis of the information about the position of the front end 31 and not on the basis of contents on the back side of the printing paper 3. Accordingly, the conventional heat transfer printer cannot be applied to printing that requires that contents on the front side of the printed paper 300 should be positioned in correspondence with contents on the back side, as in the case of picture postcards.

SUMMARY OF THE INVENTION

A first aspect of the present invention is directed to a printing device for use with a continuous sheet of printing paper, wherein the front side of the printing paper is a printing surface on which a desired print is printed, and the back side thereof is an already printed surface in which regular-form print areas printed with a given print are intermittently provided with blank areas interposed therebetween, with positional references provided in the blank areas. According to the present invention, the printing device comprises a feeding mechanism for feed-driving the printing paper, a printing mechanism provided to face the front side of the printing paper in a path in which the printing paper is fed, for printing the desired print, a cutter provided on a paper-discharge side for the printing paper offset from the printing mechanism, a sensor provided in the path for sensing the positional reference, and control means for controlling the feeding mechanism, the printing mechanism, and the cutter on the basis of a sense output from the sensor. The printing mechanism prints the front side of the printing paper corresponding to the regular-form print area through control by the control means, and the cutter cuts off the blank area from the printing paper through control by the control means, thereby producing a piece of paper having the desired print on the front side and the regular-form print on the back side.

A second aspect of the present invention is directed to a printing device for use with a continuous sheet of printing paper, wherein the front side of the printing paper is a printing surface on which a desired print is printed, and the back side thereof is an already printed surface in which regular-form print areas printed with a given print are successively provided, with positional references provided in the regular-form print areas. According to the second aspect of the present invention, the printing device comprises a feeding mechanism for feed-driving the printing paper, a printing mechanism provided to face the front side of the printing paper in a path in which the printing paper is fed, for printing the desired print, a cutter provided on a paper-discharge side for the printing paper offset from the printing mechanism, a sensor provided in the path for sensing the positional reference, and control means for controlling the feeding mechanism, the printing mechanism, and the cutter on the basis of a sense output from the sensor. The printing mechanism prints the front side of the printing paper corresponding to the regular-form print area through control by the control means, and the cutter cuts off a boundary between the regular-form print areas on the printing paper through control by the control means, thereby producing a piece of paper having the desired print on the front side and the regular-form print on the back side.

Preferably, according to a third aspect of the present invention, in the printing device of the first aspect, the printing mechanism is a thermal head having an effective heating width equal to or larger than the paper width of the printing paper.

Preferably, according to a fourth aspect of the present invention, in the printing device of the second aspect, the printing mechanism is a thermal head having an effective heating width equal to or larger than the paper width of the printing paper.

Preferably, according to a fifth aspect of the present invention, in the printing device of the first aspect, the given print in the regular-form print area is a print of a postcard surface.

Preferably, according to a sixth aspect of the present invention, in the printing device of the second aspect, the given print in the regular-form print area is a print of a postcard surface.

Preferably, according to a seventh aspect of the present invention, in the printing device of the third aspect, the given print in the regular-form print area is a print of a postcard surface.

Preferably, according to an eighth aspect of the present invention, in the printing device of the fourth aspect, the given print in the regular-form print area is a print of a postcard surface.

According to a ninth aspect of the present invention, a heat transfer printing device for use with single piece type or continuous sheet type printing paper comprises a thermal head provided in a path in which the printing paper is fed to face a printing surface of the printing paper, the thermal head having an effective heating width equal to or larger than the paper width of the printing paper.

Preferably, according to a tenth aspect of the present invention, in the printing device of the ninth aspect, the printing paper has a positional reference defined in a given position, and the printing device further comprises a feeding mechanism for feed-driving the printing paper, a cutter provided on a paper-discharge side for the printing paper offset from the thermal head, a sensor provided in the path for sensing the positional reference, and control means for controlling the feeding mechanism, the thermal head, and the cutter on the basis of a sense output from the sensor, wherein the cutter cuts off a blank area excluding a printable area in a feed direction of the printing paper through control by the control means.

Preferably, according to an eleventh aspect of the present invention, the printing device of the first aspect further comprises print detecting means provided in close proximity on a paper-supply side to the cutter in the path, wherein the control means controls the cutter on the basis of a detection output from the print detecting means, instead of the sense output from the sensor.

Preferably, according to a twelfth aspect of the present invention, the printing device of the tenth aspect further comprises print detecting means provided in close proximity on a paper-supply side to the cutter in the path, wherein the control means controls the cutter on the basis of a detection output from the print detecting means, instead of the sense output from the sensor.

According to the first aspect of the present invention, the positional reference provided in the blank area allows the desired print on the front side of the printing paper to be accurately positioned in correspondence with the regular-form print area on the back side of the printing paper. Further, the blank area is cut away, and a piece of paper having no blank in print in the feed direction and no positional reference can be produced.

According to the second aspect of the present invention, the positional reference in the blank area allows the desired print on the front side of the printing paper to be precisely positioned to the regular-form print area on the back side of the printing paper.

According to the third aspect of the present invention, it is possible to eliminate the blank in print in the width direction of the piece of paper produced in the first aspect.

According to the fourth aspect of the present invention, it is possible to eliminate the blank in print in the width direction of the piece of paper produced in the second aspect.

According to the fifth aspect of the present invention, it is possible to produce a desired print on the front side of the printing paper in accurate register with respect to the postcard surface to produce a picture postcard with smaller blank or no blank.

According to the sixth aspect of the present invention, it is possible to print a desired print on the front side of the printing paper in a place precisely positioned to the postcard surface.

According to the seventh aspect of the present invention, it is possible to produce a desired print on the front side of the printing paper in accurate register with the postcard surface to produce a picture postcard with smaller blank or no blank.

According to the eighth aspect of the present invention, it is possible to produce a desired print on the front side of the printing paper in a place precisely positioned to the postcard surface to produce a picture postcard with smaller blank or no blank.

According to the ninth aspect of the present invention, it is possible to produce a piece of paper printed with a desired print without blank in the paper width direction.

According to the tenth aspect of the present invention, it is possible to produce a piece of paper without blank in print in the feed direction by cutting the blank area away. For example, a piece of paper very similar to a picture postcard having a frameless photograph print on the front side can be produced.

According to the eleventh aspect of the present invention, the length of margin for preventing formation of blank in the feed direction can be set shorter.

According to the twelfth aspect of the present invention, the length of margin for preventing formation of blank in the feed direction can be set shorter.

The present invention has been made to solve the problems described above, and an object of the present invention is to obtain a printing device that can produce pieces of paper having no blanks and can position the print on the front side of the printing paper to contents on the back side thereof.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
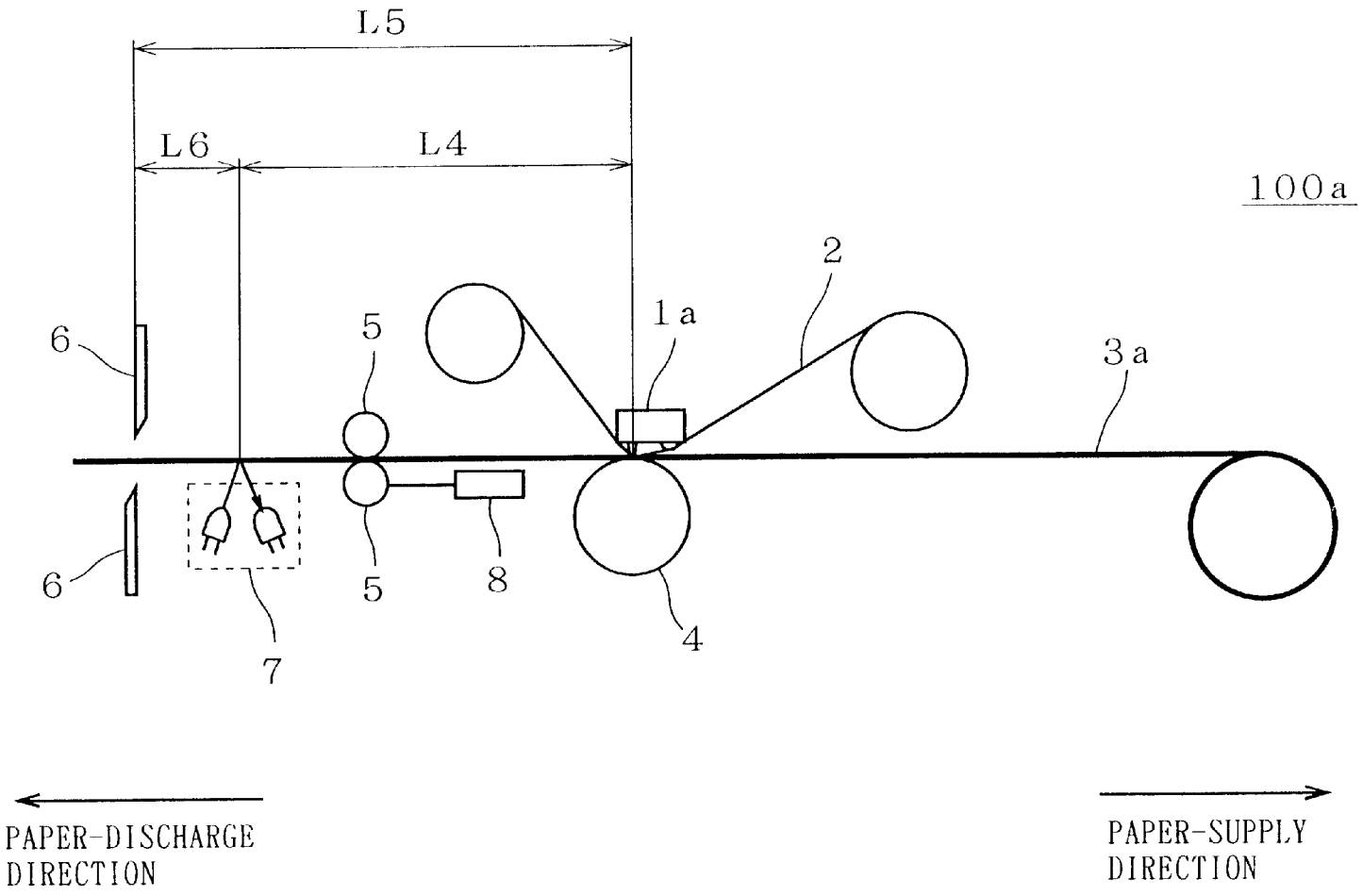
FIG. 1 is a conceptual diagram showing a mechanism of a printing device according to a first preferred embodiment of the present invention.

First, the structure of a printing device (a heat transfer printer device) according to a first preferred embodiment of the present invention will be described. FIG. 1 is a conceptual diagram showing the mechanism 100*a* of the printing device in the first preferred embodiment of the present invention. In FIG. 1, 1*a* denotes a thermal head for producing desired print, 2 denotes an ink sheet coated with thermo-dissolving ink or thermo-sublimating ink for heat transfer recording, 3*a* denotes a continuous sheet of roll-type printing paper, 4 denotes a platen roller for transferring the sheet of printing paper 3*a* while pressing the sheets in close contact against the thermal head 1*a*, 5 denotes pinch rollers for transferring the printing paper 3*a* while gripping the paper, 6 denotes a cutter for cutting the printing paper 3*a*, 7 denotes a reflection-type optical sensor, and 8 denotes a pulse motor for rotating the pinch rollers 5.

The thermal head 1*a*, platen roller 4, pinch rollers 5, sensor 7, and cutter 6 are provided in the path in which the printing paper 3*a* is sent. The thermal head 1*a* is located to face the front side of the printing paper 3*a*. The platen roller 4 is located to face the back side of the printing paper 3*a*. The thermal head 1*a* and the platen roller 4 face each other. The pinch rollers 5 and the cutter 6 are provided in this order in the paper-discharge direction from the thermal head 1*a*. The sensor 7 is provided in the path between the pinch rollers 5 and the cutter 6, for example, to face the back side of the printing paper 3*a*. The platen roller 4, the pinch rollers 5 and the pulse motor 8 form a feeding mechanism for feed-driving the printing paper 3*a*.

The distance from the thermal head 1*a* to the sensor 7 is taken as L4, the distance from the thermal head 1*a* to the cutter 6 as L5, and the distance from the sensor 7 to the cutter 6 as L6.

Figure 2:
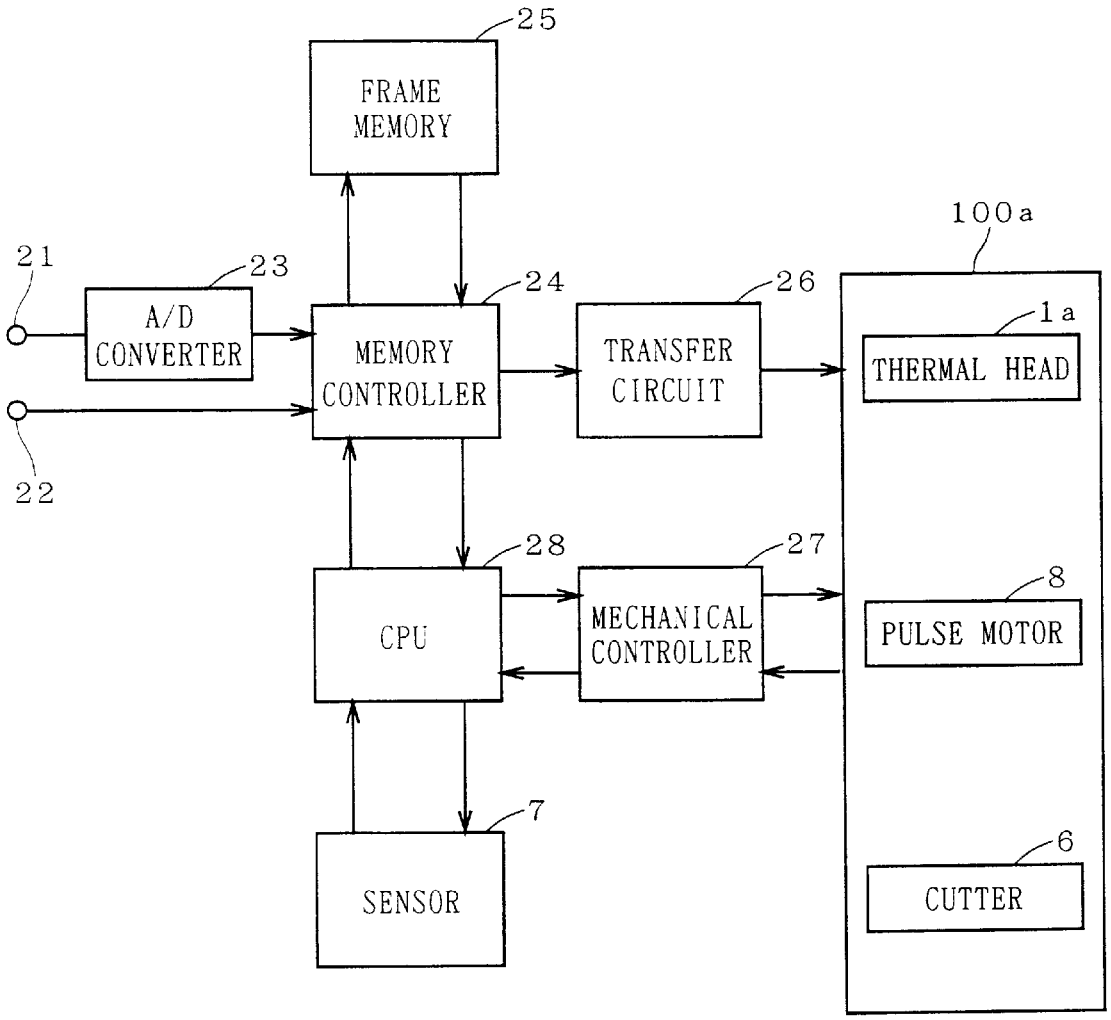
FIG. 2 is a block diagram showing the controlling system of the printing device according to the first preferred embodiment of the present invention.

FIG. 2 is a block diagram showing the controlling system of the printing device in the first preferred embodiment of the present invention. In FIG. 2, 21 denotes a terminal receiving an analog picture signal, 22 denotes a terminal receiving a digital picture signal, 23 denotes an analog-to-digital converter for converting analog picture signal from the terminal 21 into a digital picture signal, 24 denotes a memory controller functioning as an input/output interface for a picture signal and a control signal, 25 denotes a frame memory for storing the digital picture signal provided from the terminal 22 or the A/D converter 23 through the memory controller 24 as picture data, 26 denotes a transfer circuit receiving picture data in the frame memory 25 through the memory controller 24, for applying data conversion for printing to the picture data and outputting the data to the thermal head 1*a*, 27 denotes a mechanical controller for controlling the pulse motor 8, the thermal head 1*a* and the cutter 6 in the mechanism 100*a*, and 28 denotes a CPU for controlling the sensor 7, the memory controller 24, and the mechanical controller 27. The part including the A/D converter 23, the memory controller 24, the frame memory 25, the transfer circuit 26, the mechanical controller 27, and the CPU 28 (hereinafter referred to as "the CPU 28 etc.") forms a control means.

Figure 3:
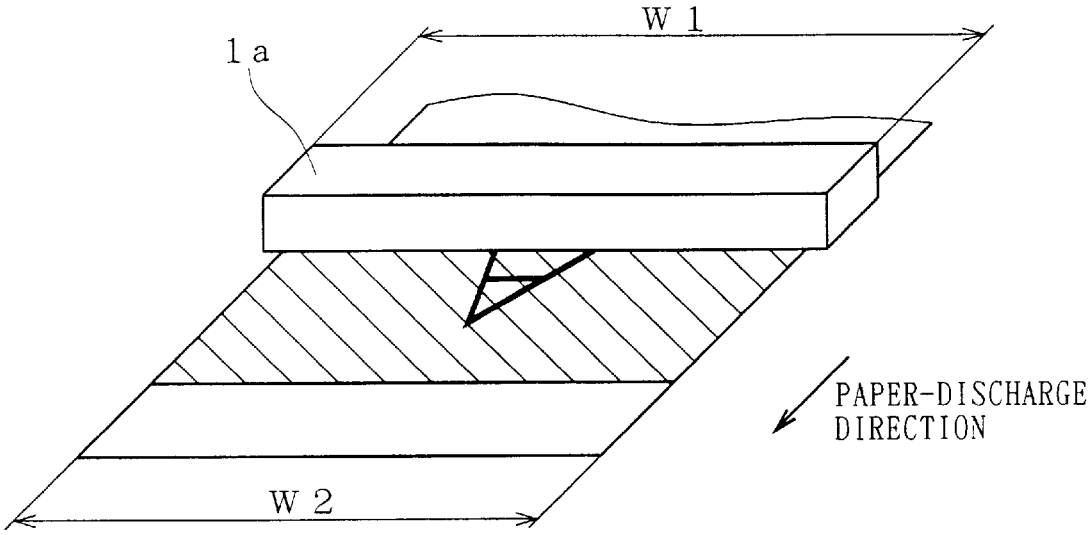
FIG. 3 is a conceptual diagram showing the thermal head according to the first preferred embodiment of the present invention.

FIG. 3 is a conceptual diagram showing the thermal head 1*a* in the first preferred embodiment of the present invention. The effective heating width W1 of the thermal head 1*a* is set to be equal to or larger than the paper width W2 of the printing paper 3*a*. The effective heating element is the part where heat is generated when the thermal head 1*a* prints. This is the part that can produce print on the printing paper.

Figure 4:
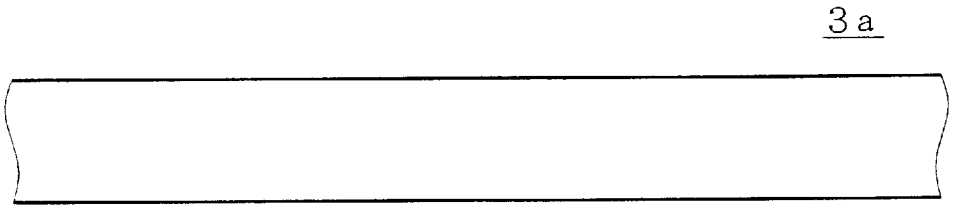
FIG. 4 is a diagram showing the front side of the printing paper in the first preferred embodiment of the present invention.
Figure 5:
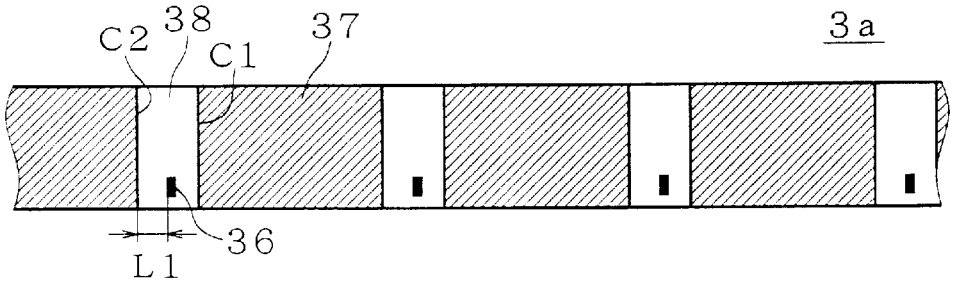
FIG. 5 is a diagram showing the back side of the printing paper in the first preferred embodiment of the present invention.

Next, the continuous printing paper 3*a* in the first preferred embodiment will be described. FIG. 4 is a diagram showing the front side of the printing paper 3*a* and FIG. 5 is a diagram showing its back side. The front side of the printing paper 3*a* forms the printing surface on which desired print is produced, which is empty without any figure, for example. The back side of the printing paper 3*a* is an already printed surface, which includes regular-form print areas 37 printed with postcards intermittently provided with blank areas 38 therebetween. The blank area 38 contains a black mark 36 serving as a positional reference. The reference character C1 denotes a boundary (a cut position) on the paper-discharge side between the regular-form print area 37 and the blank area 38, C2 denotes a boundary (a cut position) on the paper-supply side between the regular-form print area 37 and the blank area 38, and L1 denotes the distance from the mark 36 to the cut position C2.

Figure 6:
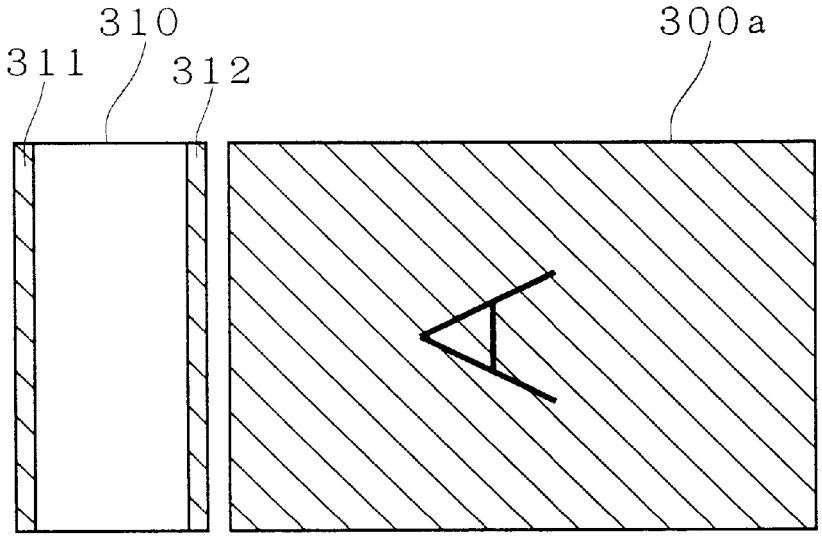
FIG. 6 is a diagram showing the front side of a printed piece of paper produced in the first preferred embodiment of the present invention.
Figure 7:
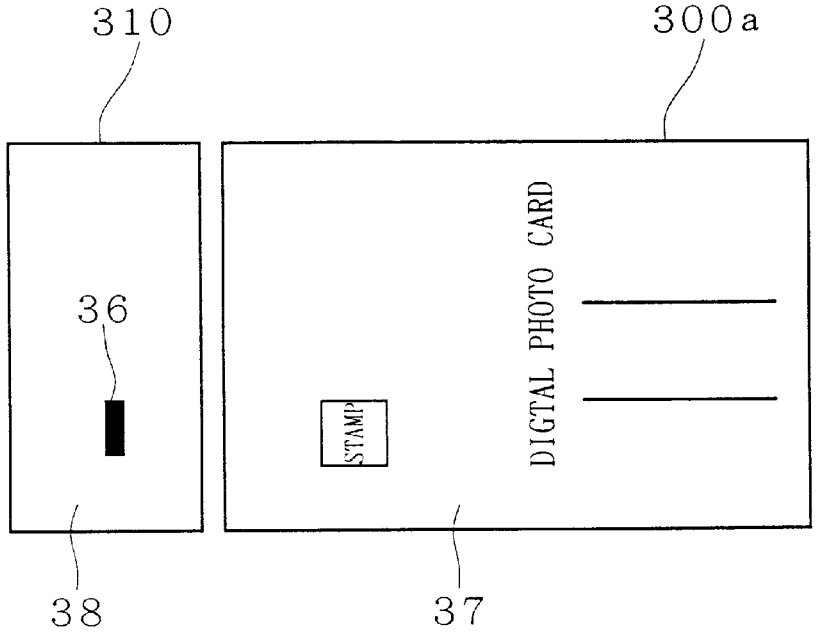
FIG. 7 is a diagram showing the back side of the printed piece of paper produced in the first preferred embodiment of the present invention.

FIG. 6 is a diagram showing the front side of a printed piece of paper produced in the first preferred embodiment and FIG. 7 shows the back side thereof. The back side of the printed piece 300*a* corresponds to the regular-form print area 37. The back side of the piece of paper 310 is the blank area 38. The printed piece of paper 300*a* has a desired print on the front side and a print of a postcard surface on the back side. The parts 311 and 312 are prints left on the piece of paper 310 as cutting margins for the cutter 6.

Figure 8:
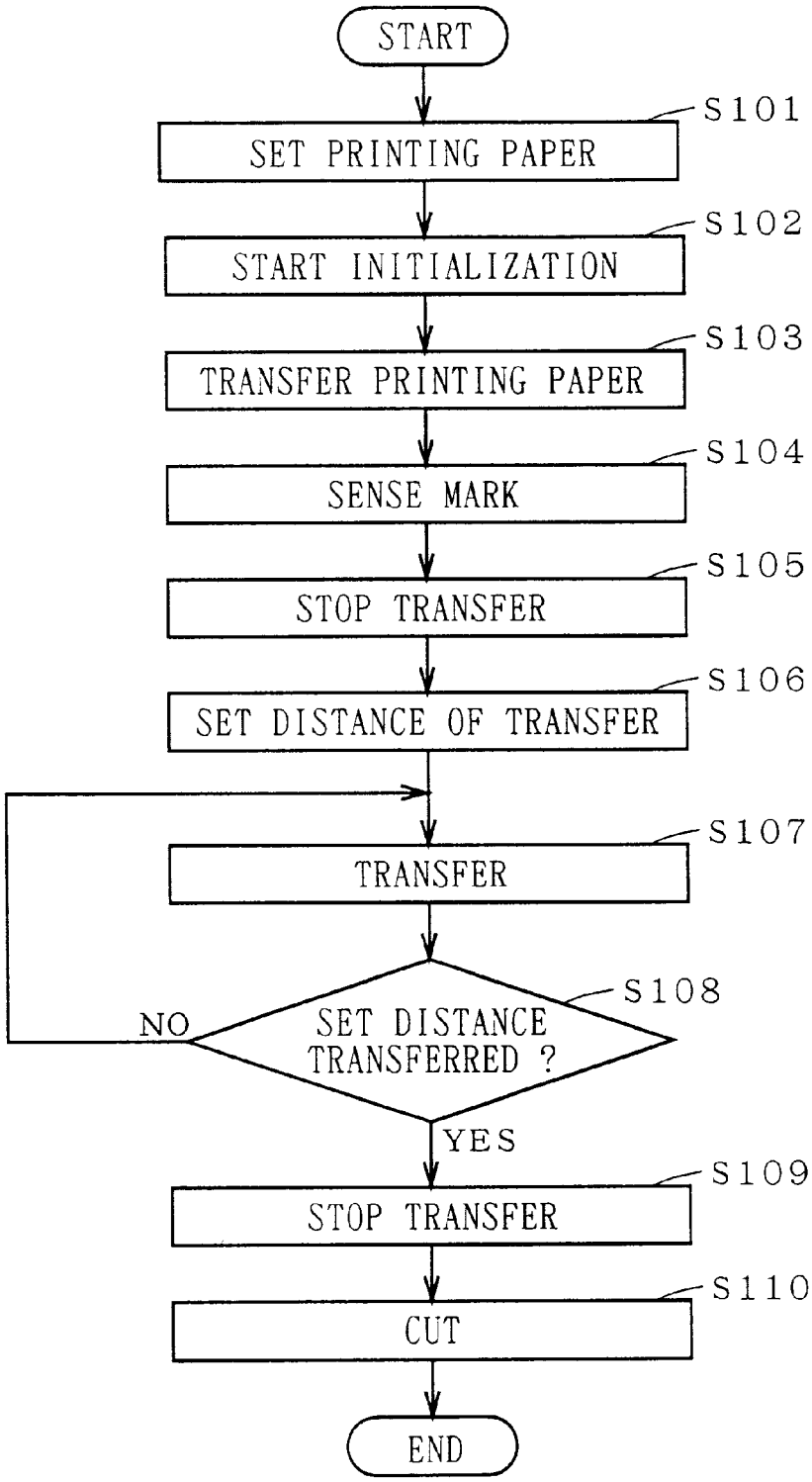
FIG. 8 and FIG. 9 are flow charts showing operation of the printing device according to the first preferred embodiment of the present invention.
Figure 9:
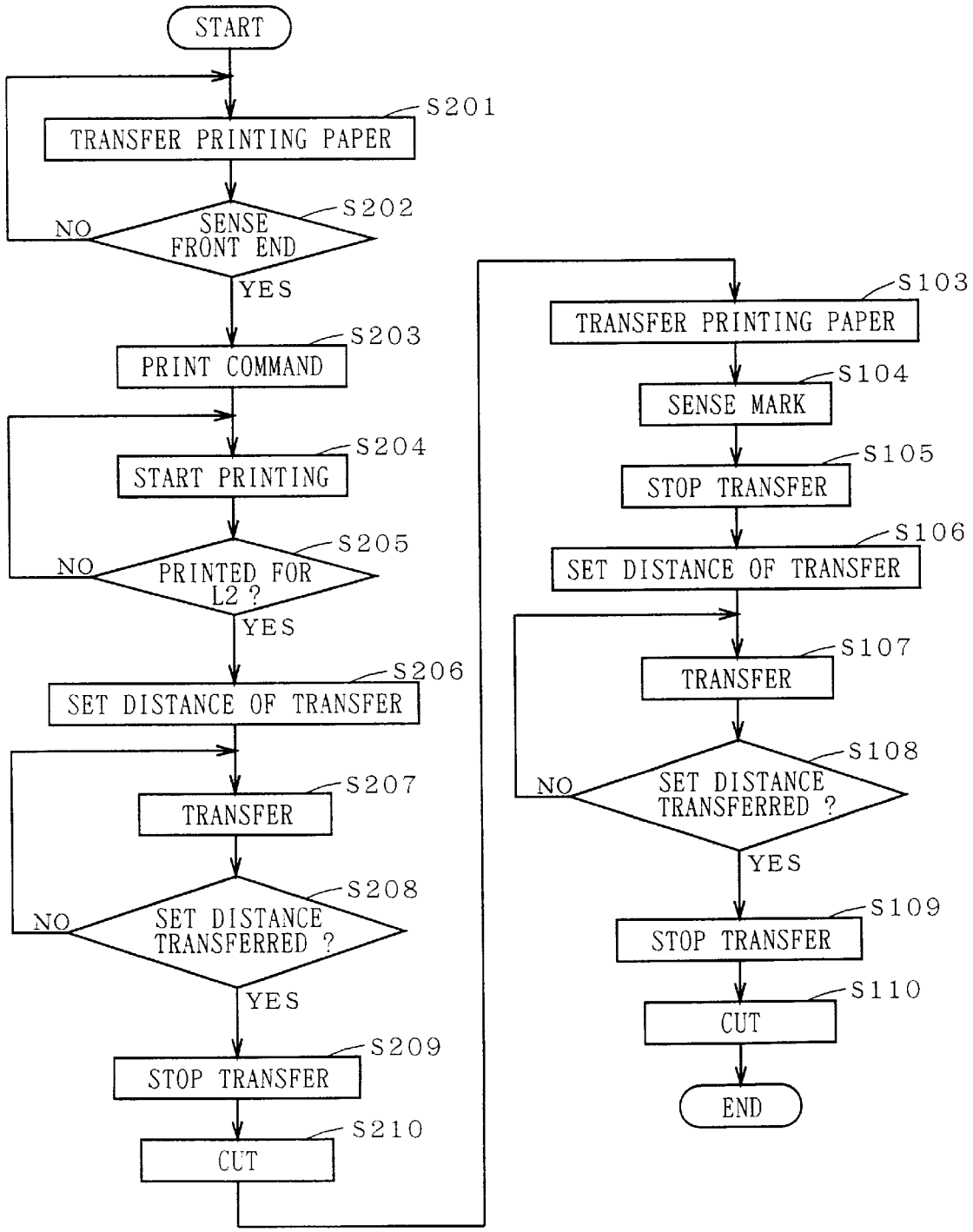
Figure 10:
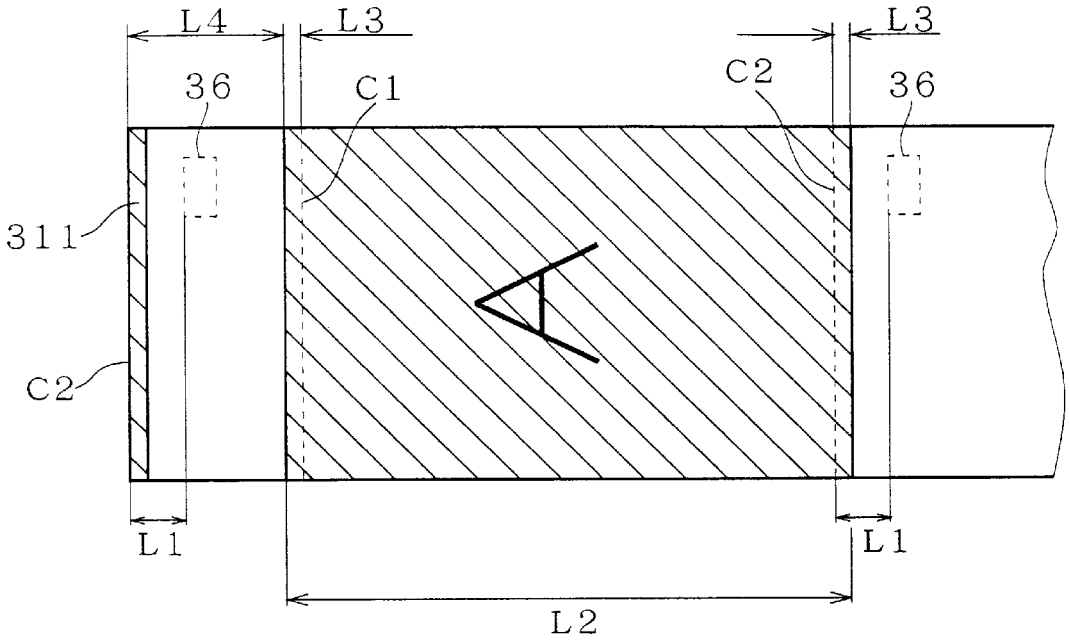
FIG. 10 is a diagram showing dimensions in the printing paper.
Figure 11:
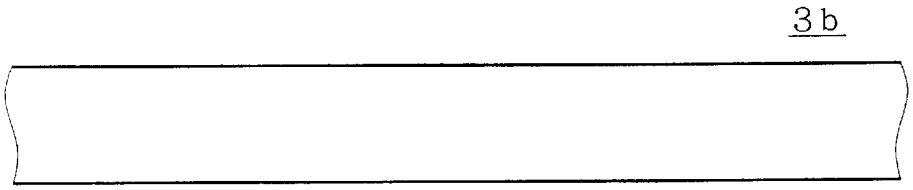
FIG. 11 is a diagram showing the front side of the printing paper according to a second preferred embodiment of the present invention.

Next, operation of the printing device in the first preferred embodiment will be described referring to FIG. 1, FIG. 2, FIG. 8 to FIG. 10. In the operation of the printing device in the first preferred embodiment, FIG. 8 provides a flow chart showing operation in initialization based on control by the CPU 28 etc., and FIG. 9 provides a flow chart showing operation for producing a printed piece of paper based on the control by the CPU 28 etc. FIG. 10 shows dimensions in the printing paper 3*a*. In FIG. 10, L3 shows the length of the cutting margin shown in FIG. 6 in the feed direction, L4 shows the length between the cut positions C1 and C2 minus L3, L2 shows the length of the print, and other characters correspond to those in FIG. 5 and FIG. 6.

First, referring to FIG. 8, the operation for initialization of the printing device will be described. The printing paper 3*a* is set in the printing device (Step S101) and the initialization starts (Step S102).

Next, in Steps S103 to S110, the cutter 6 cuts the paper at the cut position C2. More specifically, the pinch rollers 5 transfer the printing paper 3*a* to bring the mark 36 located on the front end side of the printing paper 3*a* closer to the sensor 7 (Step S103). When the sensor 7 senses the mark 36 on the printing paper 3*a* (Step S104), the pinch rollers 5 temporarily stop transferring (Step S105). At this moment, the mark 36 is positioned at the sensor 7. The sensor 7 radiates light and receives the reflected light to sense the mark 36 or the front end of the printing paper 3*a*. The CPU 28 reads a previously set amount of transfer (here, the difference between L1 and L6) and sets it in the mechanical controller 27 (Step S106). Note that L1 is longer than L6. Next, the pinch rollers 5 transfer the printing paper 3*a* in the paper-supply direction (Step S107). When the pinch rollers 5 have transferred the printing paper 3*a* in the distance set in the mechanical controller 27 (Step S108), they then stop transferring (Step S109). At this moment, the cut position C2 is located at the cutter 6. The cutter 6 cuts the printing paper 3*a* (Step S110).

After the initialization of the printing device, a printed piece of paper is produced. First, referring to FIG. 9, in Steps S201 to S205, a desired print is made on the front side of the printing paper 3*a*. In more detail, the pinch rollers 5 transfer the printing paper 3*a* in the paper-supply direction (Step S201). When the sensor 7 senses the cut position C2 at the front end of the printing paper 3*a* (Step S202), the CPU 28 outputs a printing command. At this time, the CPU 28 outputs the printing command to the memory controller 24 and the mechanical controller 27 (Step S203). In response, the pinch rollers 5 start transferring the printing paper 3*a* in the paper-discharge direction. Correspondingly, the thermal head 1*a* starts heat transfer on the basis of the picture data provided from the frame memory 25 through the memory controller 24 and the transfer circuit 26 (Step S204). The pinch rollers 5 move the printing paper 3*a* for the length L2 in the paper-discharge direction, and a desired print is produced in the length L2 (Step S205). Desired print is produced on the front side of the printing paper 3*a* in this way.

Since the front end of the printing paper 3*a* is moved back to the position of the sensor 7 in Steps S201 to S202, the length of the piece of paper 310 shown in FIG. 6 in the feed direction can be shorter. Thus, the front end of the printing paper 3*a* is sensed in Step S202 not for the purpose of positioning the contents on the front side in correspondence with the contents on the back side.

In Steps S206 to S210, the cutter 6 cuts the paper at the cut position C1. In more detail, the CPU 28 reads a previously set amount of transfer and sets it in the mechanical controller 27 (Step S206). Next, the pinch rollers 5 transfer the printing paper 3*a* in the paper-supply direction (Step S207). The pinch rollers 5 transfer the printing paper 3*a* for the amount of transfer set by the CPU 28 (Step S208) and then stops transferring (Step S209). At this time, the cut position C1 is positioned at the cutter 6. The cutter 6 cuts the printing paper 3*a* (Step S210).

The amount of transfer is set in Step S206 as follows. At the time when the processing in Step S205 is finished, the front end of the desired print is protruding over the cutter 6 in the paper-discharge direction and the rear end of the desired print is located at the thermal head 1*a*. Accordingly, to position the cut position C1 at the cutter 6, the printing paper 3*a* is first moved in the paper-supply direction for the length of the protrusion over the cutter 6, i.e., for (L2−L5), and is next moved in the paper-discharge direction for L3. That is to say, the amount of transfer, L7, in Step S206 is L2−L5+L3.

Next, similarly to the operation in Steps S103 to S110, the paper is cut at the cut position C2 by the cutter 6.

As described above, the sensor 7 senses the mark 36 on the printing paper 3*a*, and the CPU 28 etc. control the thermal head 1*a* and the cutter 6 on the basis of the sense output from the sensor 7 so that the thermal head 1*a* applies heat transfer printing on the front side of the printing paper 3*a* corresponding to the regular-form print area 37 and the cutter 6 cuts off the blank area 38 from the printing paper 3*a*, whereby the printing device produces the printed piece of paper shown in FIG. 6 and FIG. 7.

The first preferred embodiment provides the following effects.

Figure 22:
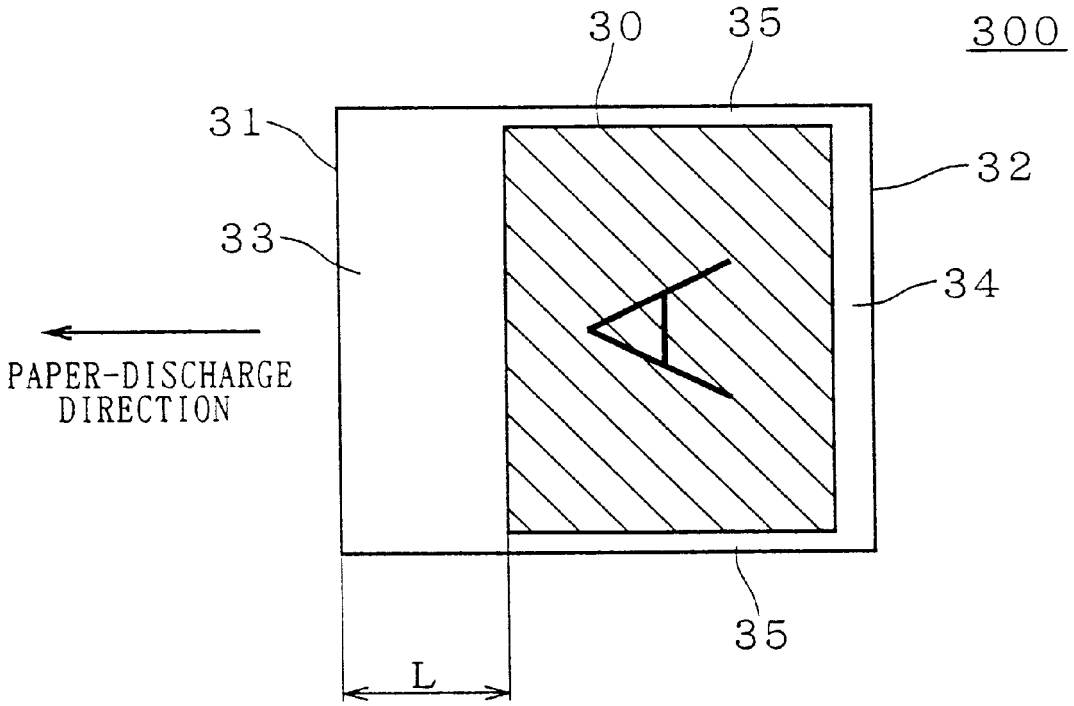
FIG. 22 BACKGROUND ART
FIG. 22 is a diagram showing the front side of a printed piece of paper produced in a conventional manner.

As shown in FIG. 6, since the printed piece 300*a* does not have the blank 33, the blank 34, and the blanks 35 shown in FIG. 22, it looks very much like a frameless photograph.

It is possible to produce a desired print on the front side of the printing paper 3*a* with accurate positioning to the regular-form print area 37 on the back side of the printing paper 3*a*.

When a postcard surface is printed on the back side, it is possible to produce a card very similar to a picture postcard printed with a frameless photograph on the front side.

Since the mark 36 is formed in the blank area 38, the mark 36 is not left on the produced printed piece 300*a*.

Second Preferred Embodiment

A second preferred embodiment uses the printing device of the first preferred embodiment.

Figure 12:
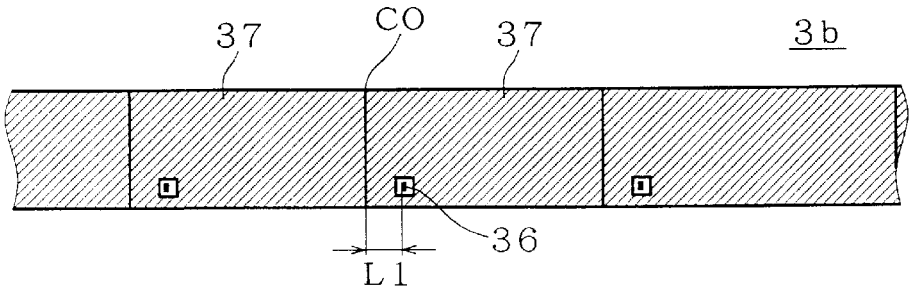
FIG. 12 is a diagram showing the back side of the printing paper according to the second preferred embodiment of the present invention.

Next, a continuous sheet of printing paper 3*b* in the second preferred embodiment will now be described. FIG. 1 is a diagram showing the front side of the printing paper 3*b* and FIG. 12 shows its back side. The front side of the printing paper 3*b* is a printing surface on which desired print is produced, which is empty without any figure, for example. The back side of the printing paper 3*b* is an already printed surface including the regular-form print areas 37 printed with postcard printing.

Unlike those in the first preferred embodiment, the regular-form print areas 37 are continuously provided in the second preferred embodiment. The character C0 shows a boundary (cut position) between successive regular-form print areas 37. The mark 36 is provided in the regular-form print area 37. The character L1 shows the distance from the mark 36 to the cut position C0.

Figure 13:
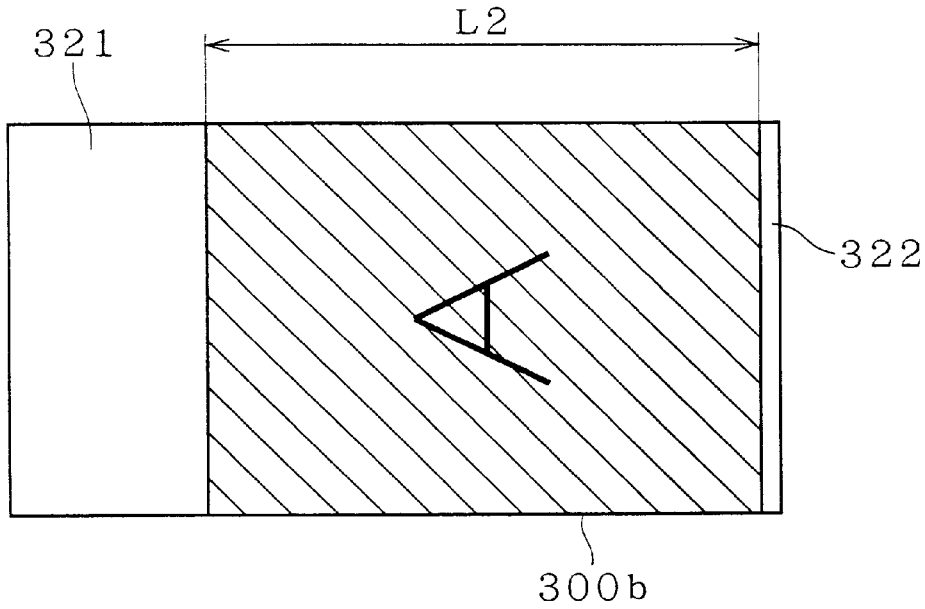
FIG. 13 is a diagram showing the front side of a printed piece of paper produced in the second preferred embodiment of the present invention.
Figure 14:
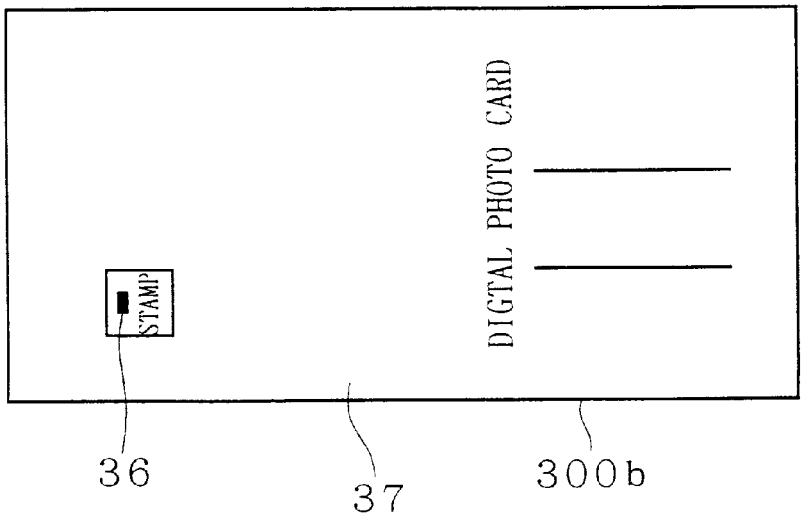
FIG. 14 is a diagram showing the back side of the printed piece of paper produced in the second preferred embodiment of the present invention.

FIG. 13 is a diagram showing the front side of a printed piece of paper produced in the second preferred embodiment, and FIG. 14 shows its back side. The back side of the printed piece 300*b* is the regular-form print area 37.

The printed piece of paper 300*b* has a desired print on the front side and a print of a postcard on the back side. Unlike that in the first preferred embodiment, the blanks are not cut off as a piece of paper 310 in the second preferred embodiment. That is to say, the areas 321 and 322 are formed as blanks on the printed piece 300*b*. The mark 36 is provided inside the area in which a stamp is put on the postcard.

Figure 15:
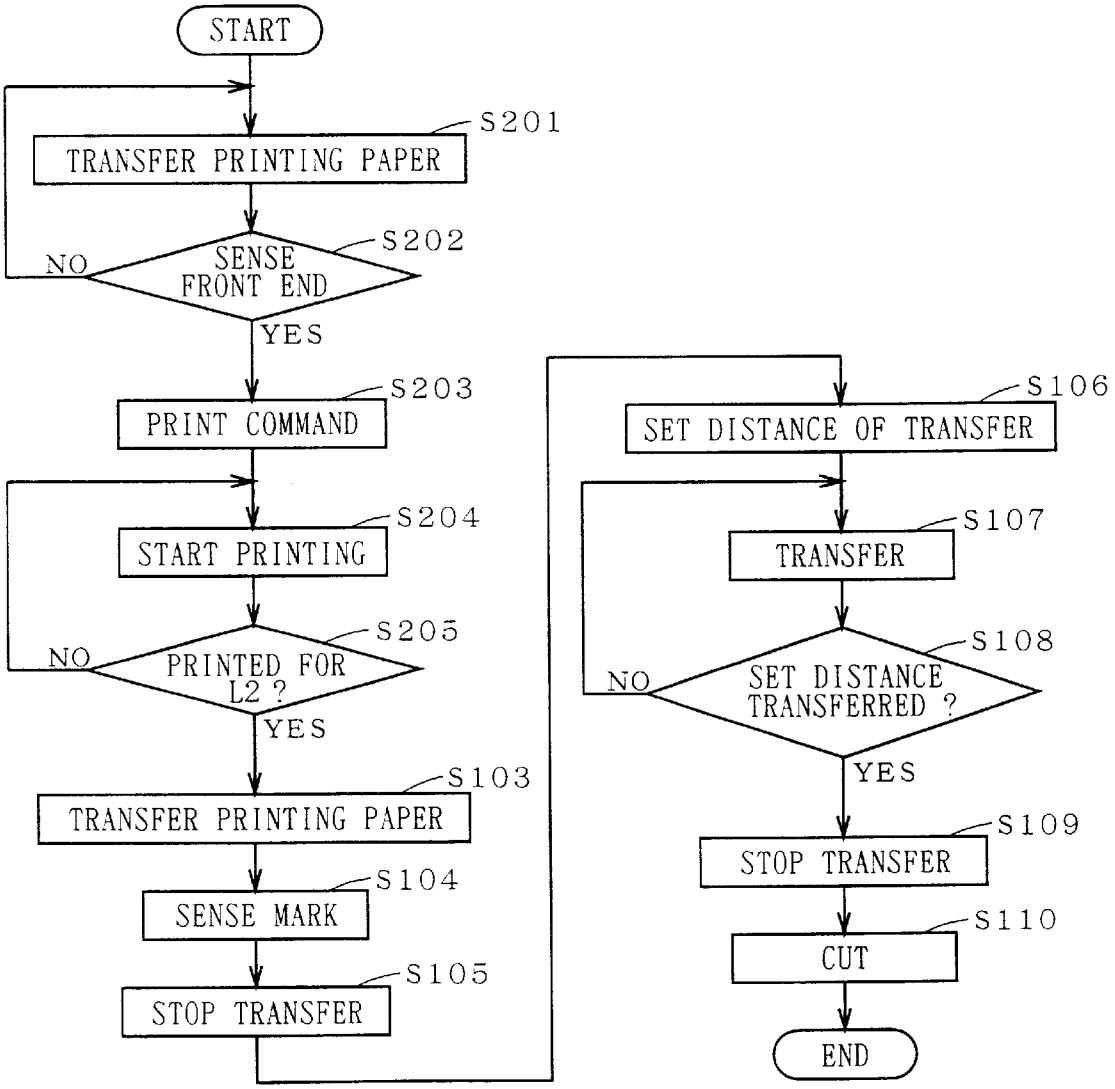
FIG. 15 is a flow chart showing operation of the printing device of the second preferred embodiment of the present invention.

Next, operation of the printing device in the second preferred embodiment will be described. In the operation of the printing device in the second preferred embodiment, FIG. 15 is a flow chart showing operation for producing a printed piece, which corresponds to that shown in FIG. 9 with Steps S206 to S210 removed.

First, similarly to the first preferred embodiment, the printing device is initialized. Here, the printing paper 3*b* is used.

After initialization of the printing device, a printed piece is produced. First, in Steps S201 to S205, a desired print is produced on the front side of the printing paper 3*b* as described in the first preferred embodiment. However, note that in the second preferred embodiment the length L2 of the desired print is set so that it can be contained within the front side of the printed piece 300*b* shown in FIG. 13.

Next, similarly to the first preferred embodiment, the paper is cut by the cutter 6 at the cut position C0, instead of at the cut position C2, in Steps S103 to S110.

As described above, the sensor 7 senses the mark 36 on the printing paper 3*b* and the CPU 28 etc. control the thermal head 1*a* and the cutter 6 on the basis of the sense output from the sensor 7 so that the thermal head 1*a* applies heat transfer printing on the front side of the printing paper 3*b* corresponding to the regular-form print area 37 and the cutter 6 cuts the printing paper 3*b* at the cut position C0 between the regular-form print areas 37, whereby the printing device produces the printed piece of paper shown in FIG. 13 and FIG. 14.

The second preferred embodiment provides the following effect.

It is possible to produce a desired print on the front side of the printing paper 3*b* with accurate positioning to the regular-form print area 37 on the back side of the printing paper 3*a*.

Third Preferred Embodiment

Figure 16:
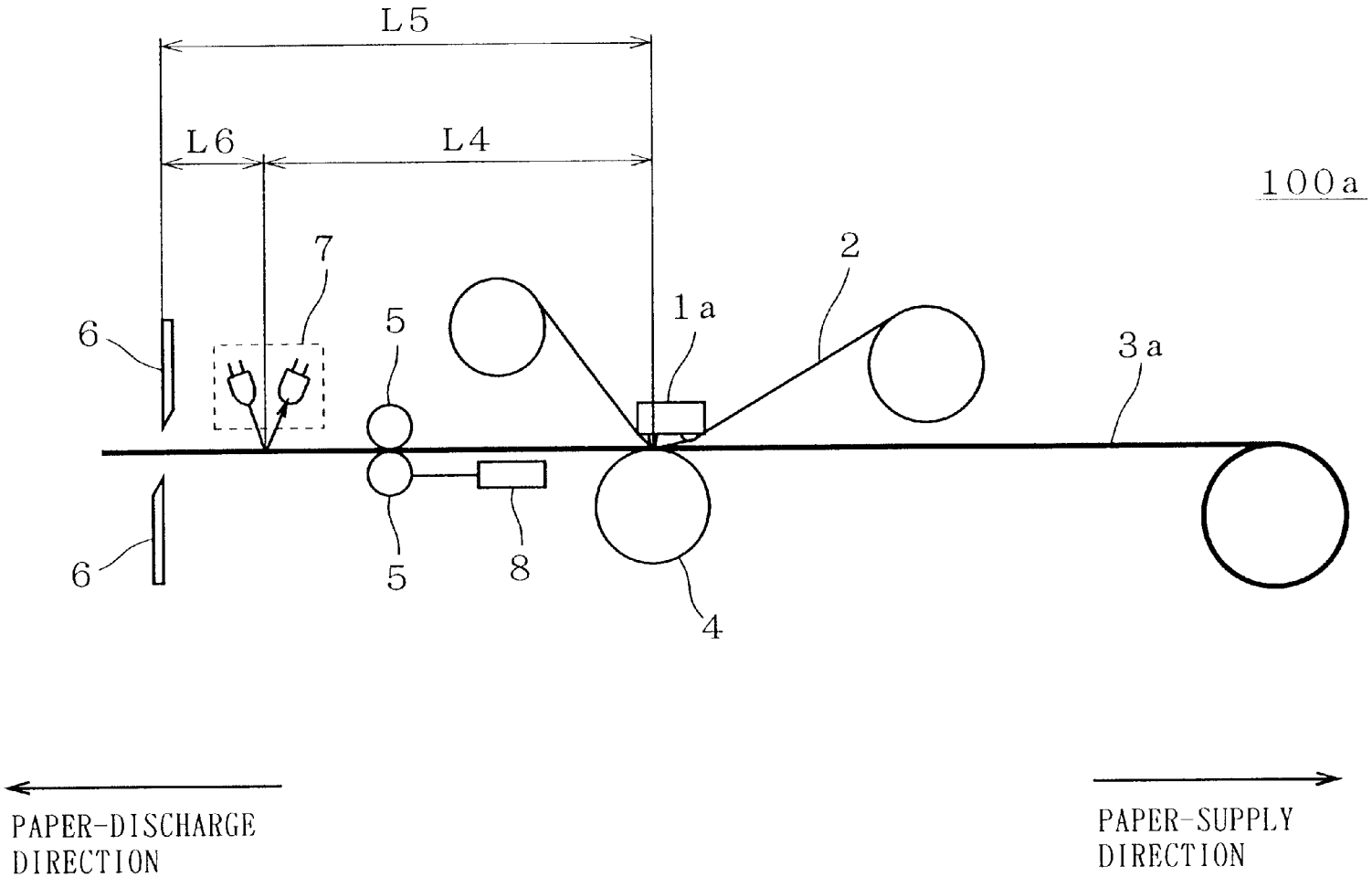
FIG. 16 is a conceptual diagram showing the mechanism of a printing device according to a third preferred embodiment of the present invention.

First, the structure of a printing device according to a third preferred embodiment of the present invention will be described. FIG. 16 is a conceptual diagram showing the mechanism 100*a* of the printing device in the third preferred embodiment of the present invention. The reference characters in FIG. 16 correspond to those in FIG. 1. The sensor 7 is provided in the path between the pinch rollers 5 and the cutter 6 on the front side of the printing paper 3*a*. In other respects, the structure of the printing device of the third preferred embodiment is the same as that of the first preferred embodiment.

Figure 17:
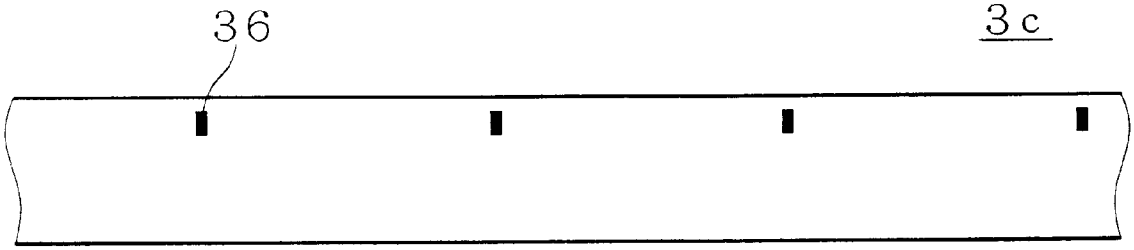
FIG. 17 is a diagram showing the front side of the printing paper in the third preferred embodiment of the present invention.

Next, a continuous sheet of printing paper 3*c* in the third preferred embodiment will be described. FIG. 17 is a diagram showing the front side of the printing paper 3*c*. The front side of the printing paper 3*c* is a printing surface on which desired print is provided, where marks 36 are provided at constant intervals in the paper supply/discharge direction. The intervals between the marks 36 are the same as those between the marks 36 shown in FIG. 5. That is to say, although the marks 36 are provided on the back side of the printing paper 3*a* in the first preferred embodiment, the marks 36 are provided on the front side of the printing paper 3*c* in the third preferred embodiment. The back side is empty, for example.

Figure 18:
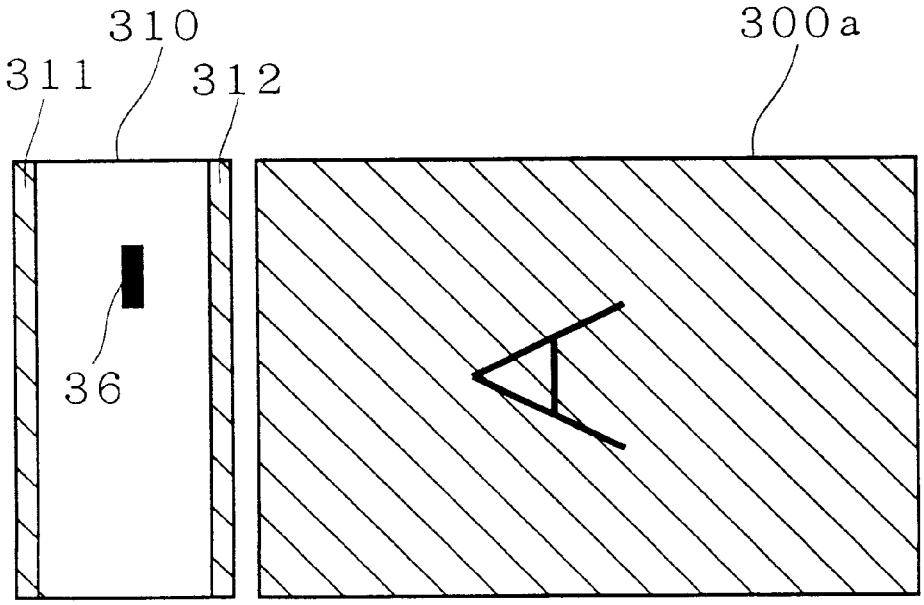
FIG. 18 is a diagram showing the front side of a printed piece of paper produced in the third preferred embodiment of the present invention.

FIG. 18 is a diagram showing the front side of a printed piece of paper produced in the third preferred embodiment. The reference characters in FIG. 1 correspond to those in FIG. 6. The front side of the piece of paper 310 has a mark 36.

Next, the printing device in the third preferred embodiment operates similarly to that in the first preferred embodiment. That is to say, the sensor 7 senses the mark 36 on the printing paper 3*c* and the CPU 28 etc. control the thermal head 1*a* and the cutter 6 on the basis of the sense output from the sensor 7 so that the thermal head 1*a* applies heat transfer printing on the front side of the printing paper 3*c* and the cutter 6 cuts off the part excluding the printable area in the paper supply/discharge direction of the printing paper 3*c*, i.e., the piece of paper 310, as a blank area having the mark 36, whereby the printing device produces the printed piece 300*a* shown in FIG. 18.

The third preferred embodiment provides the following effect.

As shown in FIG. 18, since the printed piece of paper 300*a* does not have the blank 33, the blank 34 and the blanks 35 shown in FIG. 22, it can be produced as a piece of paper that looks very like a frameless photograph.

Fourth Preferred Embodiment

Figure 19:
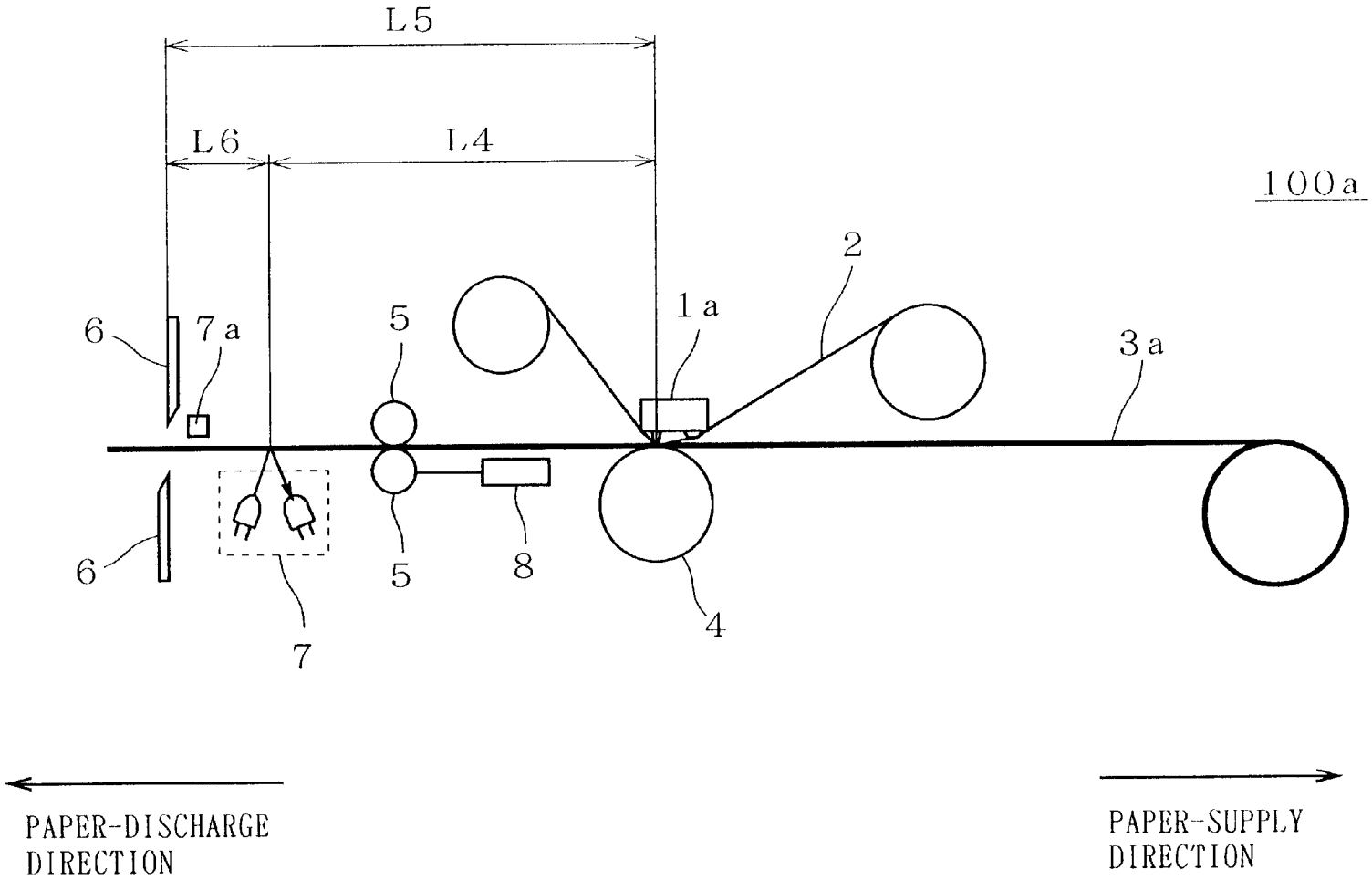
FIG. 19 is a conceptual diagram showing the mechanism of a printing device according to a fourth preferred embodiment of the present invention.
Figure 20:
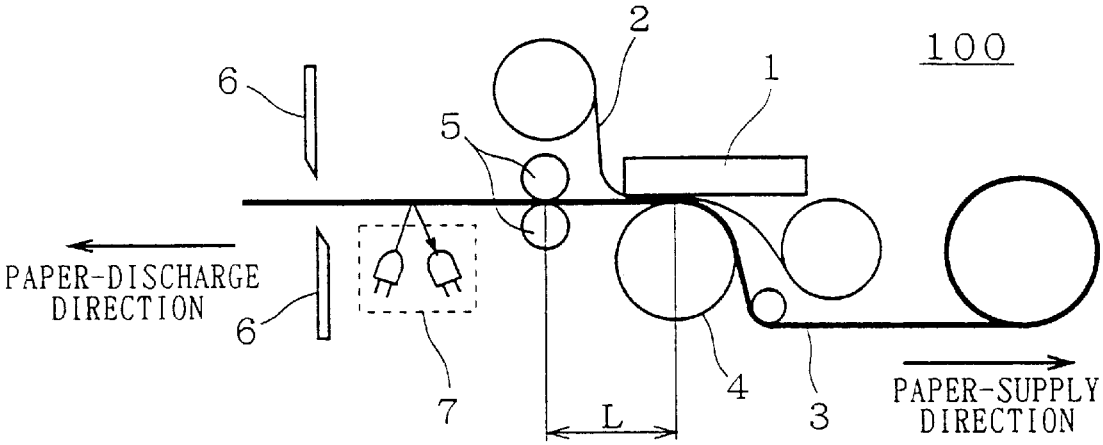
FIG. 20 BACKGROUND ART
FIG. 20 is a conceptual diagram showing a mechanism of a conventional printing device.

First, the structure of a printing device in a fourth preferred embodiment of the present invention will be described. FIG. 19 is a conceptual diagram showing the mechanism 100*a* of the printing device in the fourth preferred embodiment of the present invention. The reference characters in FIG. 19 correspond to those in FIG. 1. A print detecting means, e.g., a CCD image scanner 7*a*, is provided in the path between the pinch rollers 5 and the cutter 6 on the front side of the printing paper 3*a*, quite close to the cutter 6 on its paper-supply side. The image scanner 7*a* is connected to the CPU 28. In the other respects, the structure of the printing device in the fourth preferred embodiment is the same as that of the first preferred embodiment.

Next, for the most part, the printing device of the fourth preferred embodiment operates similarly to that of the first preferred embodiment. In the fourth preferred embodiment, the printing device performs the following operation instead of Steps S206 to S209. That is to say, the pinch rollers 5 transfer the printing paper 3*a* in the paper-supply direction. The image scanner 7*a* detects the printed part on the front side of the printing paper 3*a* and then provides the detection output to the CPU 28. On receiving the detection output, the CPU 28 etc. control the pinch rollers 5 to immediately stop transferring the printing paper 3*a*. The pinch rollers 5 stop transferring through the control.

Further, in the fourth preferred embodiment, the following operation is performed in place of Steps S103 to S109. That is to say, the pinch rollers 5 transfer the printing paper 3*a* in the paper-discharge direction. When the image scanner 7*a* detects unprinted part on the front side of the printing paper 3*a*, it provides the detection output to the CPU 28. Receiving the detection output, the CPU 28 etc. control the pinch rollers 5 to immediately stop transferring the printing paper 3*a*. Through the control, the pinch rollers 5 stop transferring.

The fourth preferred embodiment provides the following effect.

In the first preferred embodiment, the margin length L3 for preventing formation of blank in the feed direction on the front side of the printed piece 300*a* is set long. However, in the fourth preferred embodiment, since the printing paper 3*a* is cut immediately when the image scanner 7*a* detects print on the front side of the printing paper 3*a*, L3 can be set shorter.

Modifications

In the first or third preferred embodiment, the positional reference may be something else that can be sensed by the sensor 7, such as holes passing through the printing paper from the front to the back, in place of the marks 36.

In the first and second preferred embodiments, the front end of the printing paper cannot be used as a positional reference, since it is necessary to register contents on the front side and contents on the back side. On the other hand, since it is not necessary in the third preferred embodiment to position the contents on the front side to the contents on the back side, the front end of the printing paper may be used as the positional reference.

Although the third preferred embodiment uses a continuous, roll-type sheet of printing paper having a sequence of areas for desired printing, pieces of cut-type (single-piece type) printing paper having separated printing areas may be used instead.

Although the fourth preferred embodiment is applied to the first preferred embodiment, it may be applied to the third preferred embodiment.

Figure 21:
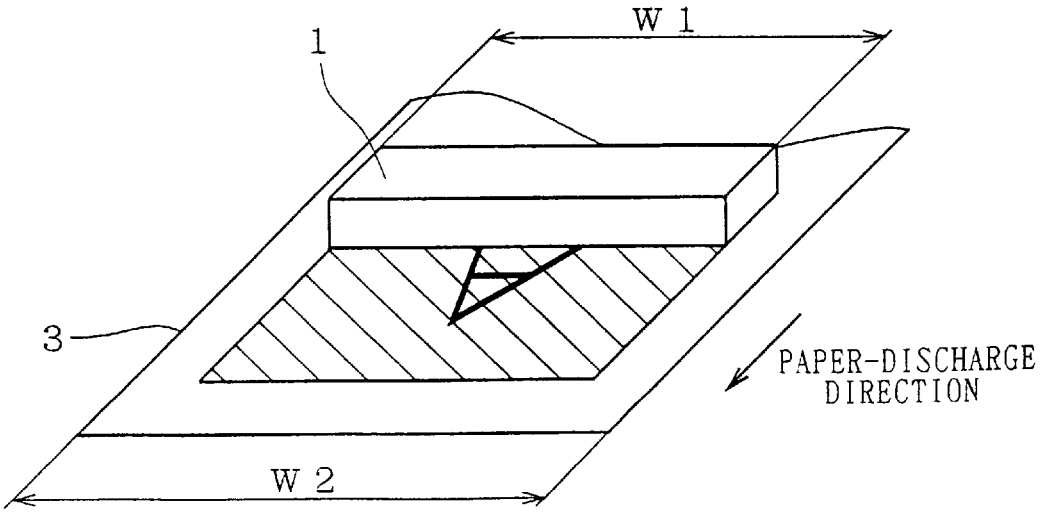
FIG. 21 BACKGROUND ART
FIG. 21 is a conceptual diagram showing a conventional thermal head.

Further, in the first and second preferred embodiments, if blanks in the paper width direction are allowed, the thermal head 1 shown in FIG. 21 may be used in place of the thermal head 1*a*. In this case, the second preferred embodiment provides the effect of producing printed pieces of paper that are very similar to picture postcards having photograph printing with frames on the front side.

The first to fourth preferred embodiments use a monochrome or color heat transfer recording system using an ink-sheet coated with thermo-dissolving ink or thermo-sublimating ink. However, a monochrome or color heat transfer recording system using thermosensible paper as printing paper requiring no ink sheet may be used.

The first and second preferred embodiments have described applications to a heat transfer printer device having a heat transfer system printing mechanism (the thermal head). However, the preferred embodiments may be applied to ink jet printer devices having ink jet type printing mechanisms, laser printer devices having laser print type printing mechanisms, etc.

While the invention has been described in detail, the foregoing description is in all aspects illustrative and not restrictive. It is understood that numerous other modifications and variations can be devised without departing from the scope of the invention.

We claim:

1. A printing device for use with a continuous sheet of printing paper, a first side of said printing paper being a printing surface on which a desired print is printed, and a second side thereof being a previously printed surface in which regular-form print areas are intermittently provided with blank areas interposed therebetween, with positional references provided in said blank areas, said printing device comprising:

a feeding mechanism for feed-driving said printing paper;

a printing mechanism facing the first side of said printing paper in a path in which said printing paper is fed, for printing said desired print;

a cutter provided on a paper-discharge side of said printing mechanism;

a sensor provided in the paper feed path for sensing the positional references; and a controller for controlling said feeding mechanism, said printing mechanism, and said cutter based on a sense output from said sensor;

wherein said controller controls said printing mechanism to print the first side of said printing paper corresponding to said regular-form print area, said controller controls said feeding mechanism to feed said printing paper in a first direction during a printing operation, and controls said feeding mechanism to feed said printing paper in an opposite direction to position a first cut position of said printing paper at said cutter, said cutter cutting said printing paper at said first cut position, said controller controls said feeding mechanism to feed said printing paper in said first direction after said cutter cuts said printing paper at said first cut position, and said controller controls said feeding mechanism to feed said printing paper in said opposite direction after said sensor senses a positional reference to position a second cut position of said printing paper at said cutter, said cutter cutting said printing paper at said second cut position to cut off a blank area containing the positional reference from said printing paper to produce a piece of paper having the desired print on the first side and the regular-form print on the second side.

2. The printing device according to claim 1, wherein said printing mechanism is a thermal head having an effective heating width equal to or larger than the paper width of said printing paper.

3. The printing device according to claim 1, wherein said given print in said regular-form print area is a print of a postcard surface.

4. The printing device according to claim 2, wherein said given print in said regular-form print area is a print of a postcard surface.

5. The printing device according to claim 1, wherein said sensor is in close proximity on a paper-supply side to said cutter in said feed path.

6. The printing device according to claim 1, wherein said first direction is a paper discharge direction, and said opposite direction is a paper supply direction.

7. A printing device for use with single piece type or continuous sheet type printing paper, comprising:

a thermal head provided in a path in which the printing paper is fed to face a printing surface of the printing paper, said thermal head having an effective heating width equal to or larger than the width of the printing paper, the printing paper having a positional reference at a predetermined position;

a feeding mechanism for feed-driving the printing paper;

a cutter provided on a paper-discharge side of said printing device and offset from said thermal head;

a sensor provided in the printing paper feed path for sensing the positional reference in the printing paper; and a controller for controlling said feed mechanism, said thermal head, and said cutter based on a sensing output of said sensor, said controller controlling said cutter to cut off a non-print area of the printing paper which includes said positional reference at said predetermined position, wherein said sensor includes a sensing unit in close proximity to and offset in a paper-supply direction relative to said cutter in the printing paper feed path, and wherein said controller controls said cutter on the basis of a detection output from said sensing unit, said controller controls said feeding mechanism to feed said printing paper in a first direction during a printing operation, and controls said feeding mechanism to feed said printing paper in an opposite direction to position a first cut position of said printing paper at said cutter, said cutter cutting said printing paper at said first cut position, said controller controls said feeding mechanism to feed said printing paper in said first direction after said cutter cuts said printing paper at said first cut position, and said controller controls said feeding mechanism to feed said printing paper in said opposite direction after said sensor senses the positional reference to position a second cut position of said printing paper at said cutter, said cutter cutting said printing paper at said second cut position to remove said non-print area.

8. The printing device according to claim 7, wherein said first direction is a paper discharge direction, and said opposite direction is a paper supply direction.

* * * * *